US008092410B2

(12) United States Patent
Colin

(10) Patent No.: US 8,092,410 B2
(45) Date of Patent: Jan. 10, 2012

(54) HYDROTHERAPY JET

(75) Inventor: Raymundo Colin, Simi Valley, CA (US)

(73) Assignee: B & S Plastics, Inc., Oxnard, CA (US)

( * ) Notice: Subject to any disclaimer, the term of this patent is extended or adjusted under 35 U.S.C. 154(b) by 1113 days.

(21) Appl. No.: 11/877,563

(22) Filed: Oct. 23, 2007

(65) Prior Publication Data

US 2008/0097265 A1 Apr. 24, 2008

Related U.S. Application Data

(60) Provisional application No. 60/854,173, filed on Oct. 24, 2006.

(51) Int. Cl.
*A61H 7/00* (2006.01)

(52) U.S. Cl. ..... 601/160; 601/167; 601/169; 4/541.1; 4/541.6; 4/492

(58) Field of Classification Search ..... 601/154, 601/155, 156, 157, 158, 160, 162, 163, 165, 601/167, 169; 4/541.1, 541.2, 541.3, 541.4, 4/541.5, 541.6, 490, 491, 492, 497; 239/229, 239/251, 261, 318, 587.1
See application file for complete search history.

(56) References Cited

U.S. PATENT DOCUMENTS

| | | | | |
|---|---|---|---|---|
| 4,330,412 | A * | 5/1982 | Frederick | 4/492 |
| 4,896,383 | A | 1/1990 | Morgan et al. | 4/542 |
| 6,264,122 | B1 * | 7/2001 | Perdreau et al. | 239/600 |
| 6,860,437 | B1 * | 3/2005 | Amendt et al. | 239/383 |
| 6,889,916 | B2 | 5/2005 | Loyd et al. | 239/261 |
| 2003/0089797 | A1 * | 5/2003 | Buck | 239/261 |

* cited by examiner

*Primary Examiner* — Quang D Thanh
(74) *Attorney, Agent, or Firm* — Koppel, Patrick, Heybl & Philpott

(57) ABSTRACT

A hydrotherapy jet includes a jet body having an open upstream end and an open downstream end and defining a flow path between the open upstream end and open downstream end, a flapper disposed within the flow path, the flapper having upstream flapper and downstream flapper ends and rotatably connected to the jet body at the upstream flapper end to rotatably oscillate about the upstream flapper end when a stream of water is introduced from upstream to downstream through the flow path and a head spoiler formed on the downstream flapper end to reduce the frequency of oscillation of the flapper wherein a stream of water pulsating effect is felt by a user of the jet apparatus adjacent the open downstream end as the flapper rotatably oscillates.

22 Claims, 4 Drawing Sheets

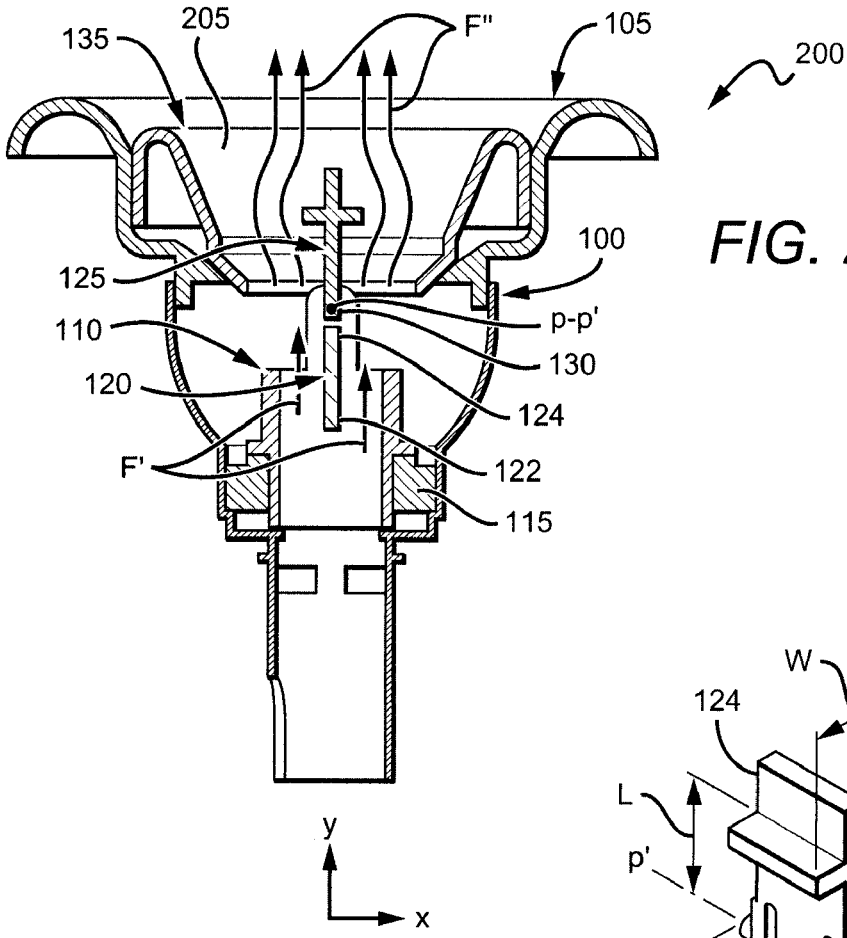
FIG. 2
FIG. 3
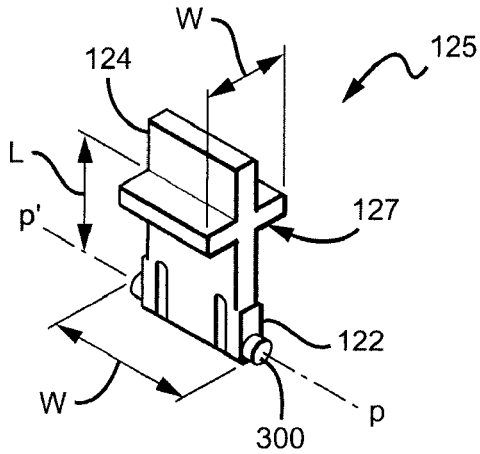
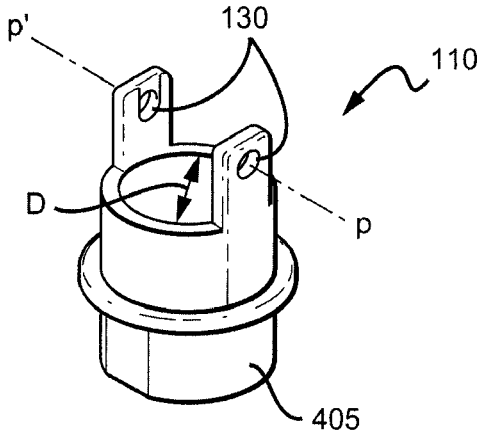
FIG. 4
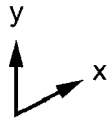

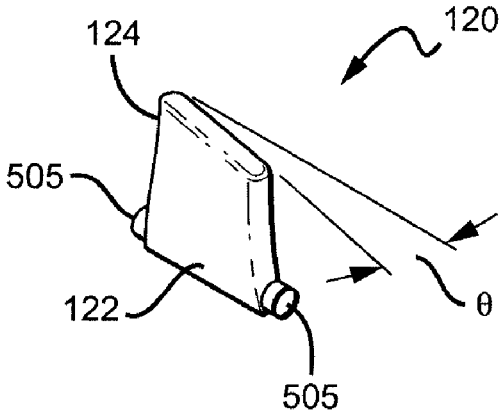
FIG. 5
FIG. 6
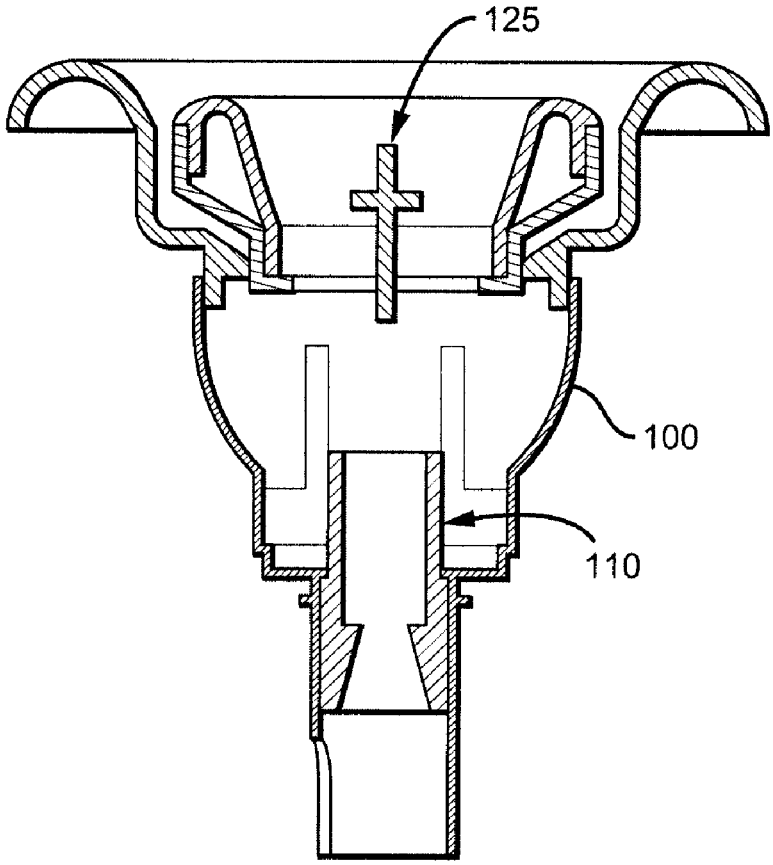

HYDROTHERAPY JET

RELATED APPLICATION

This application claims the benefit of U.S. Provisional Application No. 60/854,173, filed Oct. 24, 2006.

BACKGROUND OF THE INVENTION

1. Field of the Invention

This invention relates to hydrotherapy jets and more particularly to hydrotherapy jets generating a pulsating water stream.

2. Description of the Related Art

Spas, hot tubs, pools and bathtubs may use water discharge jets to accomplish a variety of pleasing massaging effects for their occupants. Typical jets include a rotating outlet or eyeball, with water flow through the outlet inducing the outlet's rotation to produce a pleasing massaging effect on users. A pulsating effect may also be produced using mechanical blocking devices to intermittently reduce and release a water flow, or using a hydraulic pumping device to distribute water through multiple outlets in front of a rotor. Unfortunately, use of either rotating mechanical or hydraulic pumping devices increases system component count and adds complexity in comparison to fixed jet systems, thus increasing the cost and weight of such systems.

A need continues to exist for a spa that provides massage effects without adding additional complexity and cost to the discharge jet.

SUMMARY OF THE INVENTION

A hydrotherapy jet apparatus is disclosed that includes a jet body having open upstream and downstream ends and defining a flow path between them, a flapper disposed within the flow path, the flapper having upstream and downstream flapper ends with the flapper rotatably connected to the jet body at the upstream flapper end to rotatably oscillate about the upstream flapper end when a stream of water is introduced from upstream to downstream through the flow path. A head spoiler is formed on the downstream flapper end to reduce the frequency of oscillation of the flapper, so that a stream of water pulsating effect is felt by a user of the jet apparatus adjacent the open downstream end as the flapper rotatably oscillates.

A hydrotherapy jet apparatus is also disclosed that includes a flapper having upstream and downstream flapper ends, a roto-holder rotatably coupled to the flapper at the upstream flapper end, the roto-holder having an interior portion to communicate a stream of water to the flapper, and a flapper driver positioned in the interior portion. The flapper driver is configured to impart a rotational moment on the roto-holder in response to the stream of water communicated to the flapper.

A method is disclosed that provides fluid flow through an internal flow path of a jet body, induces periodic rotational movement of a flapper disposed within the internal flow path about an upstream edge of the flapper in response to the fluid flow, and deflects fluid flow with a flapper head on the flapper to reduce the periodicity of the periodic rotational movement of the flapper.

A spa system is disclosed that includes a tub shell capable of holding a human being partially submerged below water when water is present in the tub shell, the tub shell having a drain and a spa jet body opening and a jet body coupled to the spa jet body opening. The jet body includes an open upstream end and an open downstream end and defining a flow path between the open upstream end and the open downstream end, a flapper disposed within the flow path, the flapper having a upstream flapper end and downstream flapper end, the flapper rotatably connected to the jet body at the upstream flapper end to rotatably oscillate about the upstream flapper end when a stream of water is introduced from upstream to downstream through the flow path, and a head spoiler formed on the downstream flapper end to reduce the frequency of oscillation of the flapper. The spa system also includes a water pump and a plurality of water conduits to connect the water pump to the drain and to connect the water pump to the jet body.

BRIEF DESCRIPTION OF THE DRAWINGS

The components in the figures are not necessarily to scale, emphasis instead being placed upon illustrating the principals of the invention. Like reference numerals designate corresponding parts throughout the different views.

FIG. 2 is a cross-sectional view of the hydrotherapy jet illustrated in FIG. 1;

FIG. 3 is a perspective view of one embodiment of the flapper illustrated in FIG. 1;

FIG. 4 is a perspective view of the roto-holder illustrated in FIG. 1;

FIG. 5 is a perspective view of a flapper driver illustrated in FIG. 1;

FIG. 6 is a cross-sectional view of a hydrotherapy jet.

DETAILED DESCRIPTION OF THE INVENTION

A hydrotherapy jet, in accordance with one embodiment of the invention, includes a flapper disposed in an internal flow path of a jet body, with the flapper rotatably connected to the jet body to rotatably oscillate in response to water flow to produce a pulsating effect on users positioned downstream of the hydrotherapy jet. The flapper is connected to the jet body at a upstream flapper end, and has a flapper head (alternatively called a "head spoiler") on a downstream end of the flapper to reduce its oscillation frequency from what would otherwise exist without the flapper head. The flapper, flapper head and jet body are preferably coupled in series with a pump and a plurality of water conduits for use in spas, hot tubs, pools, bathtubs and other tub shells to produce massage effects on users of such systems without additional complexity and cost in comparison to existing fixed jet systems.

Figure 1:
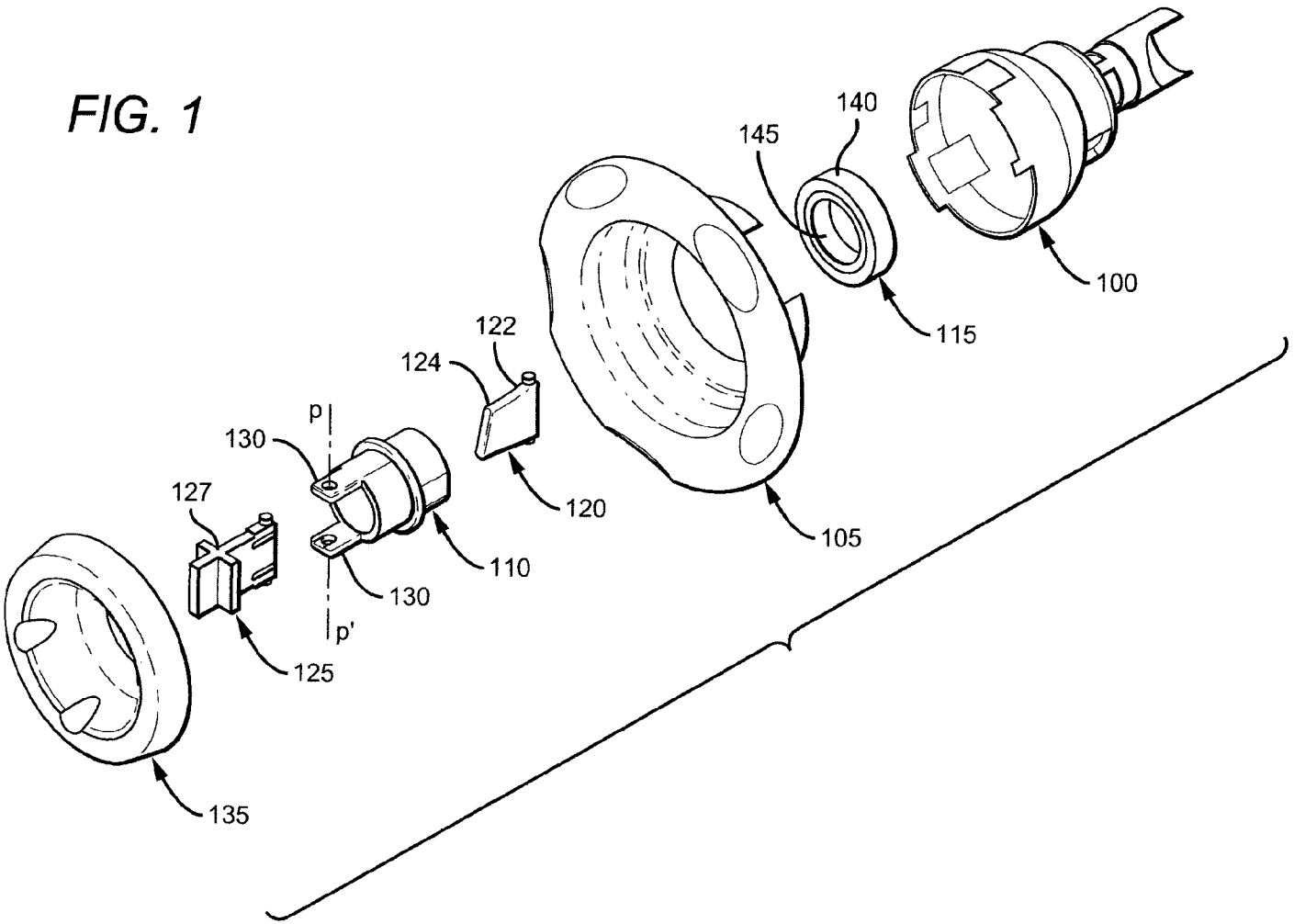
FIG. 1 is an exploded perspective view of a pulsating hydrotherapy jet illustrating one embodiment of the invention.

FIG. 1 illustrates one embodiment of the hydrotherapy jet, alternatively called a jet body or discharge jet, that has a diffuser 100 to control the flow rate of a liquid, preferably water. The diffuser 100 is coupled to an escutcheon 105 that serves as a valve handle to allow user actuation of the diffuser 100. A roto-holder 110 is coupled to a bearing assembly 115 which itself is seated in the diffuser 100 to allow rotation of the roto-holder 110 relative to the diffuser 100. The roto-holder 110 is a hollow cylindrical shape to allow fluid flow F' through it along a jet body axis. The bearing assembly 115 is preferably a sleeve-type bearing having outer fixed and inner rotating sleeves (140, 145) using ball bearings, roller bearings or other bearing type to allow rotation of the roto-holder 110 along a central access shared by the diffuser 100, escutcheon 105, and the roto-holder 110, itself. In an alternative embodiment, the bearing assembly 115 may be omitted and replaced by a structure on the roto-holder 110 which allows rotation of the roto-holder 110 about the central access.

A flapper driver 120 is seated within the interior portion of the roto-holder 110, preferably coupled to an interior side wall of the roto-holder 110, so that when water is introduced from the diffuser 100 through the roto-holder 110 and across the exposed surfaces of the flapper driver 120, the flapper driver 120 imparts a rotational moment on the roto-holder 110. The flapper driver 120 is preferably a substantially planar member having a slight angular twist (θ) between its upstream flapper end 122 and downstream flapper end 124. In an alternative implementation, the flapper driver 120 may consist of a single piece, an assembly or protrusions on the roto-holder 110 extending into the interior of the roto-holder 110 so that a rotational moment is imparted on the roto-holder 110 in response to water flowing through the roto-holder 110 and around the flapper driver 120.

A flapper 125 is coupled to the roto-holder 110 at a flapper coupler, preferably pin retaining arms 130, to allow periodic angular movement of the flapper 125 about the pin retaining arm 130 and axis P-P'. A flapper cover 135 is coupled to the escutcheon 105 to guide the flow of water around and past the flapper 125.

Although the various components of the diffuser, escutcheon, flapper driver, roto-holder and flapper (100, 105, 120, 110, 125) are manufactured from ABS material, they may be formed of PBC, delrin, polypropolyn or any rigid material suitable for the liquid design.

FIG. 2 illustrates a cross-sectional view of the assembled discharge jet 200 illustrated in FIG. 1. The diffuser 100 and roto-holder 110 are positioned to guide water past the flapper driver 120 and flapper 125. During operation, in response to water flow F' past the flapper driver 120, a rotational moment is imparted onto the roto-holder 110 by the flapper driver 120 causing it to rotate about a y-axis ("jet body axis") defined by the central axis of the diffuser and roto-holder 110 as enabled by bearing assembly 115. The flapper 125 experiences a periodic angular oscillation about axis P-P' in response to fluid flow F" flowing around opposing sides of the flapper 125. The flapper driver 120 is illustrated with an angular twist between the upstream and downstream ends (122, 124) to induce the angular moment when water flows over the opposing sides of the flapper 125. Preferably, the flapper 125 oscillates within an interior portion 205 of the flapper cover 135 so that a user of a spa in which the jet is installed is not impacted by flapper 125 as it oscillates.

One embodiment of the flapper 125 is illustrated in FIG. 3, where the head 127 of the flapper 125 forms a cross in cross section. Two pins 300 extend from each side of the upstream end 122 to rotatably couple with the pin retaining arms 130 (not shown). In one implementation, the length L between the upstream end 122 and the base of the head 127 is 2 cm and the width W of the head 127 is 2 cm. The flapper 125 has a slightly tapered width from the downstream to upstream ends (124, 122) to aid with manufacture. Although the angular twist from upstream to downstream ends is preferably 10° other angular twists may be used, such as 5° and 25°, that result in different angular moments imparted on the roto-holder 110 for a given F' flow rate. For example, an increased and decreased angular twist would result in greater and lesser angular moments imparted on roto-holder 110 for a given F' flow rate, respectively. Although illustrated in generally a rectangular shape, the flapper 125 may be round, trapezoidal, square or of other shape with a hinged point along one side to enable periodic angular velocity of the flapper 125 to produce a therapeutic affect on a user of the hydrotherapy jet.

Although one dimension of length L and width W has been described, other dimensions are possible to allow changed frequency of oscillation of the flapper 125. For example, increasing the length L would result in a shorter period of oscillation and less amplitude of travel for the head 127 about axis P-P'. Similarly, a smaller value of length L would result in a longer period of oscillation and travel about P-P'.

FIG. 4 illustrates one embodiment of a roto-holder 110 that has pin retaining arms 130 that rotatably couple in a complimentary fashion with pins 300 to allow angular oscillation of the flapper 125 (not shown) about axis P-P'. The inner diameter D of roto-holder 110 is suitably chosen for complementary operation with the flapper and flapper driver (125, 120) (not shown). A bearing surface 405 receives and couples to the inner rotating sleeve 145 of the bearing assembly 115 to allow rotation about the y-axis.

FIG. 5 illustrates one embodiment of a flapper driver 120 that has angular twist θ between its upstream and downstream ends (122, 124). Pins (alternatively called flanges) 505 extend from opposite sidewalls of the upstream end 122 of the flapper driver 120 for insertion into pin retaining arms 130.

FIG. 6 illustrates an alternative embodiment of the invention, with the roto-holder 110 coupled to the diffuser 100 without the benefit of a bearing so that the roto-holder 110 is fixed and unable to rotate. The flapper 125 is again coupled to the roto-holder 110 at pin retaining arms (not shown) to allow periodic angular movement of the flapper 125 about the pin retaining arm as illustrated in FIG. 1.

Figure 7:
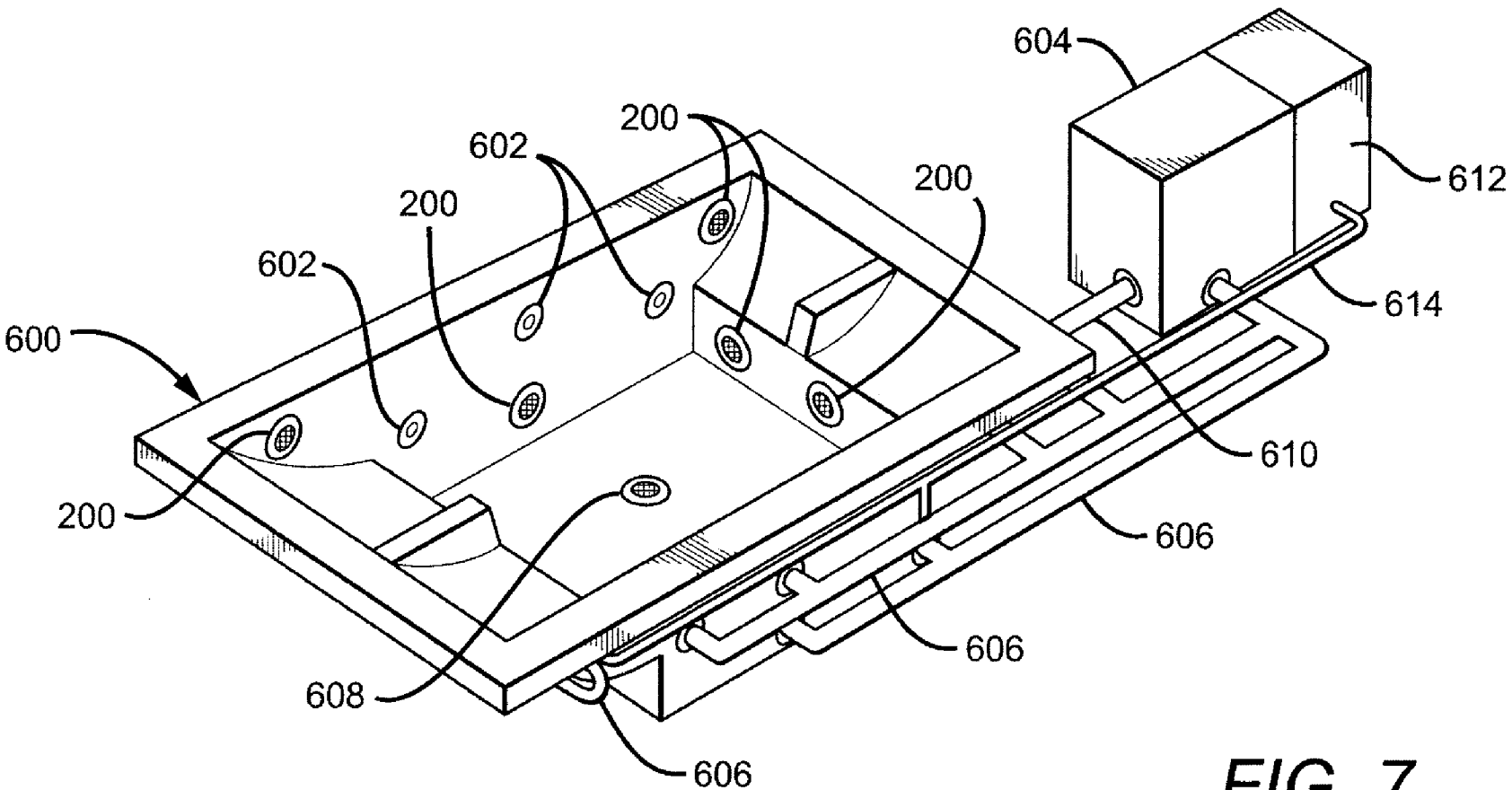
FIG. 7 is a perspective view of one embodiment of a spa system incorporating the pulsating hydrotherapy jet illustrated in FIG. 1.

FIG. 7 illustrates a spa or tub shell 600 with a plurality of spa discharge jets 200 that is capable of holding a human being partially submerged below water when water is present in the tub shell. The remaining jets can be a variety of prior art jets 602. Both types of jets are connected to a water pump system 604 to circulate the water throughout the spa system through a series of water conduits 606. Water carried by shell 600 is provided to water pump system 604 through a drain 608 which is connected to a return water conduit 610 and then to water pump system 604. Water from water pump system 612 is provided back to shell 600 by the conduits 606. An air system 612 may be provided to provide air to individual spa discharge jets 200 and prior art jets 602 through air conduit 614. To aerate the water flowing through the jets. The air system 612 may be pump driven to increase the pressure of the air entering the jets, or the system can be vacuum based in which the venture located within the jets draw the air into the water flow stream.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

I claim:

1. A hydrotherapy jet apparatus, comprising:

a jet body having an open upstream end and an open downstream end and defining a flow path between said open upstream end and said open downstream end;

a flapper disposed within said flow path, said flapper having a upstream flapper end and a downstream flapper end and said flapper rotatably connected to said jet body at said upstream flapper end to rotatably oscillate about said upstream flapper end when a stream of water is introduced from upstream to downstream through said flow path;

a head spoiler formed on said downstream flapper end to reduce the frequency of oscillation of said flapper;

wherein a stream of water pulsating effect is felt by a user of the jet apparatus adjacent said open downstream end as the flapper rotatably oscillates; and a roto-holder coupled to said jet body, said roto-holder having a flapper coupler to rotatably receive said flapper at said upstream flapper end, wherein said flapper coupler comprises a first pin retaining arm and a second pin retaining arm.

2. The apparatus of claim 1, further comprising:

a flapper driver coupled to at least one interior side wall of said roto-holder to impart a rotational moment on said roto-holder when introduced to the stream of water.

3. The apparatus of claim 2, wherein said flapper driver extends across an interior diameter of said roto-holder.

4. The apparatus of claim 3, wherein said flapper driver further comprises flapper driver upstream and downstream ends and said flapper driver is substantially planar.

5. The apparatus of claim 4, wherein said flapper driver has a slight angular twist between said flapper driver upstream and flapper driver downstream ends.

6. The apparatus of claim 1, further comprising:

a bearing assembly coupled between said roto-holder and said jet body to enable the roto-holder to rotate within said jet body.

7. The apparatus of claim 1, wherein said head spoiler comprises first and second pins on opposite sides of said head spoiler.

8. The apparatus of claim 7 , wherein said first flange extends the width of said head spoiler.

9. The apparatus of claim 1, wherein said flapper is composed of a rigid material.

10. A hydrotherapy jet assembly, comprising:

a flapper having an upstream flapper end and a downstream flapper end;

a roto-holder rotatably coupled to said flapper at said upstream flapper end, said roto-holder having an interior portion to communicate a stream of water to said flapper; and a flapper driver positioned in said interior portion, said flapper driver configured to impart a rotational moment on said roto-holder in response to the stream of water communicated to said flapper, wherein said roto-holder comprises pin retaining arms rotatably coupled to said upstream flapper end.

11. The apparatus of claim 10, wherein said flapper further comprises a head spoiler formed at said downstream flapper end to reduce the frequency of oscillation of said flapper.

12. The apparatus of claim 11, wherein said head spoiler comprises first and second pins on opposite sides of said head spoiler.

13. The apparatus of claim 12, wherein said first flange extends substantially across the width of said head spoiler.

14. The apparatus of claim 10, wherein said flapper is comprised of a rigid material.

15. A spa system, comprising:

a tub shell capable of holding a human being partially submerged below water when water is present in said tub shell, said tub shell having a drain and a spa jet body opening;

a jet body coupled to said spa jet body opening, said jet body comprising:

an open upstream end and an open downstream end and defining a flow path between said open upstream end and said open downstream end;

a flapper disposed within said flow path, said flapper having a upstream flapper end and downstream flapper end, said flapper rotatably connected to said jet body at said upstream flapper end to rotatably oscillate about said upstream flapper end when a stream of water is introduced from upstream to downstream through said flow path; and a head spoiler formed on said downstream flapper end to reduce the frequency of oscillation of said flapper;

a roto-holder coupled to said jet body, said roto-holder having a flapper coupler to rotatably receive said flapper at said upstream flapper end, wherein said flapper coupler comprises a first pin retaining arm and a second pin retaining arm;

a water pump; and a plurality of water conduits to connect the water pump to the drain and to connect the water pump to the jet body.

16. The spa system of claim 15, further comprising:

a roto-holder coupled to said jet body, said roto-holder having a flapper coupler to rotatably receive said flapper at said upstream flapper end.

17. The spa system of claim 16, further comprising:

a flapper driver coupled to at least one interior side wall of said roto-holder to impart a rotational moment on said roto-holder when introduced to the stream of water.

18. The spa system of claim 17, wherein said flapper driver extends across an interior diameter of said roto-holder.

19. A method, comprising:

providing fluid flow through an internal flow path of a jet body;

inducing periodic rotational movement of a flapper disposed within said internal flow path about an upstream edge of said flapper in response to said fluid flow, said flapper comprising a roto-holder coupled to said jet body, said roto-holder having a flapper coupler to rotatably receive said flapper at said upstream flapper end, wherein said flapper coupler comprises a first pin retaining arm and a second pin retaining arm; and deflecting fluid flow with a flapper head on said flapper to reduce the periodicity of the periodic rotational movement of said flapper.

20. The method of claim 19, further comprising:

generating a rotational moment in said flapper about a jet body axis defined by said internal flow path in response to said fluid flow;

wherein said flapper rotates about said jet body axis and periodically rotates about said upstream edge in response to the fluid flow.

21. The method of claim 19, further comprising:

providing said fluid flow to a spa reservoir.

22. A hydrotherapy jet apparatus, comprising:

a jet body having an open upstream end and an open downstream end and defining a flow path between said open upstream end and said open downstream end;

a flapper disposed within said flow path, said flapper having a upstream flapper end and a downstream flapper end and said flapper rotatably connected to said jet body at said upstream flapper end to rotatably oscillate about said upstream flapper end when a stream of water is introduced from upstream to downstream through said flow path;

a head spoiler formed on said downstream flapper end to reduce the frequency of oscillation of said flapper;

wherein a stream of water pulsating effect is felt by a user of the jet apparatus adjacent said open downstream end as the flapper rotatably oscillates;

a roto-holder coupled to said jet body, said roto-holder having a flapper coupler to rotatably receive said flapper at said upstream flapper end; and a flapper driver coupled to at least one interior side wall of said roto-holder and extends across an interior diameter of said roto-holder to impart a rotational moment on said roto-holder when introduced to the stream of water;

wherein said flapper driver further comprises flapper driver upstream and downstream ends and said flapper driver is substantially planar with a slight angular twist between said flapper driver upstream and flapper driver downstream ends.

* * * * *